US005120162A

United States Patent [19]

Parker

[11] Patent Number: 5,120,162

[45] Date of Patent: Jun. 9, 1992

[54] BUILDING FOUNDATION FORM WITH INTEGRAL DRAIN

[76] Inventor: Alton F. Parker, 8 Hiawatha Dr., Clifton Park, N.Y. 12065

[21] Appl. No.: 592,358

[22] Filed: Oct. 3, 1990

[51] Int. Cl.[5] ..... E02B 11/00; E02D 15/02

[52] U.S. Cl. ..... 405/229; 405/45; 52/169.5; 52/294; 52/742; 285/423

[58] Field of Search ..... 405/19, 43, 45, 172, 405/229; 52/169.5, 294, 742; 285/424, 423

[56] References Cited

U.S. PATENT DOCUMENTS

| | | | |
|---|---|---|---|
| 3,017,722 | 1/1962 | Smith | 405/43 X |
| 3,226,935 | 1/1966 | Schneller | 52/294 |
| 3,460,859 | 8/1969 | Keating | 285/424 X |
| 3,613,323 | 10/1971 | Hreha | 52/169.5 |
| 3,676,967 | 7/1972 | Frati | 52/220 |
| 3,903,704 | 9/1975 | Spiridonov | 405/172 X |
| 4,702,048 | 10/1987 | Millman | 52/169.5 |
| 4,733,989 | 3/1988 | Harriett | 405/43 |
| 4,757,651 | 7/1988 | Crites | 52/169.5 |
| 4,773,195 | 9/1988 | Waller | 52/169.5 |
| 4,832,557 | 5/1989 | Jacobsen | 405/19 X |
| 4,840,515 | 6/1989 | Freese | 405/45 |
| 4,858,958 | 8/1989 | Harbeke | 285/423 X |

FOREIGN PATENT DOCUMENTS

| | | | |
|---|---|---|---|
| 130523 | 6/1986 | Japan | 405/43 |

*Primary Examiner*—Randolph A. Reese
*Assistant Examiner*—Arlen L. Olsen
*Attorney, Agent, or Firm*—Schmeiser, Morelle & Watts

[57] ABSTRACT

A concrete footing/foundation retainment co-features integral (unitary) drainage means. Two preferred embodiments present, first, a rigid, environmentally nondegradable and free-standable footing/foundation concrete retainment form similar to an ordinary plank but featuring a hollow core which communicates through a multiplicity of foramens (holes) with only one face of the plank, the other being smooth and generally unrelieved in character. The second preferred embodiment presents a similar plank bearing a colinear, foraminous conduit adjacent one margin of the plank and permanently joined with the plank member. Thus, in the second embodiment, only one face is essentially smooth and unrelieved, while the other, in cross-section, appears bulbous. The bulbous feature may take on any conceivable geometric definition ranging from a semi-tubular to a rectangular conduit shape. The invention is composed of a material that lends itself, not only to environmental nondegradability, but also to ready cutting, melting or abrading. This feature allows the forms, when set as a footing/foundation retainment, to be miter-cut and, thereafter staked in place with, or without, subsequent gluing or welding by known adhesive or heating means.

15 Claims, 3 Drawing Sheets

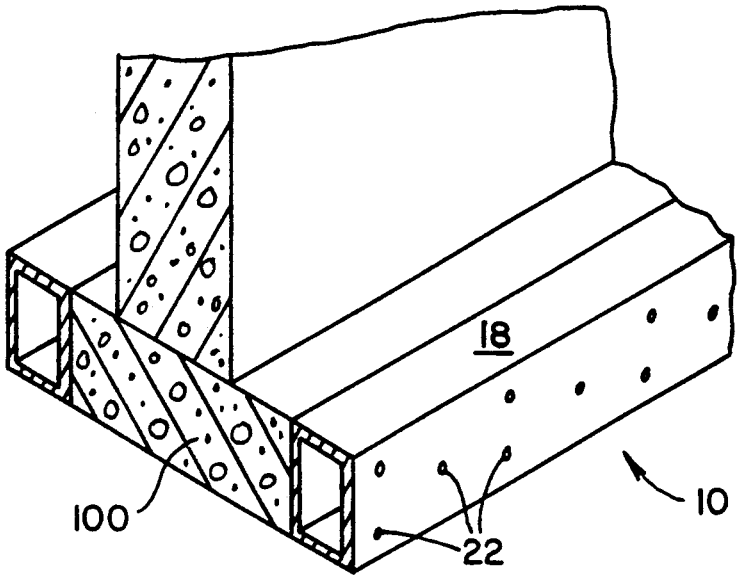
FIG. 10
FIG. 11
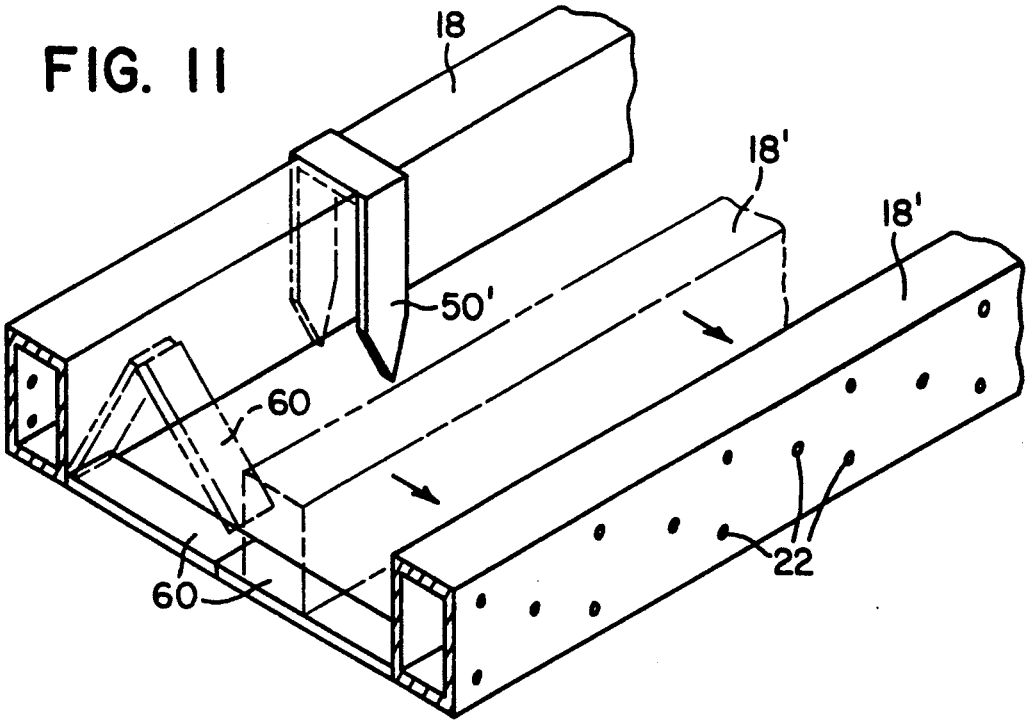

BUILDING FOUNDATION FORM WITH INTEGRAL DRAIN

BACKGROUND OF THE INVENTION

1. Field Of The Invention

This invention relates generally to structural footing forms and footing drains and in particular, to a permanent concrete footing/foundation form having an integral drain. A permanent, in-situ footing/foundation form has diverse drainage means which, because of the permanence of the form, may serve as both inside-the-structure, as well as outside-the-structure drainage.

2. Background Information

It is the practice in the building industry to excavate and set up forms for the construction of concrete footings or foundations. The forms are comprised of a plurality of planks, of varying lengths, and are otherwise unremarkable. Most of the planks are made of seasoned wood and have dimensions of varying length, generally ranging from two inches by six inches to two inches by 12 inches. In some circumstances, the forms are made of metal, but are used in a fashion analogous to the plank usage. After a trench or excavation is prepared, the planks (or the steel forms) are set up to the dimensions of the desired footing/foundation. The planks are set on edge with two planks set in a standapart registry, so that generally smooth, planar surfaces face each other. After being set in place, the planks are generally constrained by the use of wood or metal stakes. After the footing-/foundation form is firmly established, some form of restrainment, that is, a partition or anchoring device may be used to register one plank with its opposing member, thus restraining the ensemble against further movement. After completion of the entire form network, the concrete is generally poured, screeded so as to acquire a relatively smooth, bumpless surface and allowed to set and cure. After sufficient concrete hardening, the form, especially if composed of wood, is removed by a process which is as labor intensive as the initial form set-up. Irrespective of the cost of the wood planking, and it is significant enough not to be ignored, the primary reason for removing the forms and anchors (usually stakes) is that wood will, in most areas of the country, provide a haven and sustenance for wood boring and wood eating pests. Thus, removal of all wood, especially near the footing/foundation of these structures, is of paramount importance. Although there are metal form systems which are designed to remain permanently in place, by and large most are removed. Again, the same labor intensive activity is carried out.

After a footing/foundation has been constructed, a drainage means is generally provided by passing a continuous tile or perforated tubing about and contiguous to the footing/foundation, both inside and outside the periphery of that portion which will actually support the weight of the proposed structure. Inside tile is generally drained to a sump, while the outside often drains to a sewer or drywell. Like the setting or removal of the footing form, installation of the drainage feature is also costly and labor intensive. After the footing forms are removed, and before the structure floor is poured, a certain amount of retrenching must be accomplished to assure that the drainage tile is placed as close as possible to the footing and at the requisite depth. The drainage system is installed by hand and the quality of workmanship often varies with the experience of the worker, irrespective of the quality of the materials used. If construction has already started on the structure, there will be undoubtedly a sizeable amount of backfill and debris accumulated between the footing and the excavation walls. If such is the case, retrenching, prior to setting the drainage system, becomes more labor intensive since its removal may be accomplished only by hand shoveling.

Having spent a number of years in the building trades, and acquired a great deal of experience in the construction of footings, concrete flooring and drainage installation, I have developed ways and means to optimize many of the day-to-day tasks that those of us in the industry encounter. First, it seemed to me that the use of degradable materials, that is, those such as wood and other cellulose products that either decompose in the elements or are edible (or otherwise destroyed) by insects and similar pests is a choice controlled more by the initial low cost of the materials than the fact that their inherent degradability weakness necessitates a high degree of clean-up activity, which militates higher labor costs. Concurrently, it also seemed that the further expenditure of labor, to lay down a drainage system, had a concomitant increase in cost because the materials required for the drainage system must be permanent, in-situ devices which are non-degradable. Wanting to eliminate as much redundancy and labor cost as possible, I felt secondly that, if a footing/foundation form were to contain its own drainage conduit, or vice versa, there would be required but a singular installation operation, because the non-degradability of the conduit would demand that the form also be comprised of a permanent, lasting material. Extrapolating this line of reasoning further, I began to envision a footing/foundation form, used for molding concrete or similar plastic substances, that could be installed with its integral drainage system in much the same fashion as one would assemble the conventional plank-type concrete footing form. Relative to the conduit (drainage) feature, conventional around-the-corner means such as flexible ducting would be used or, if a rigid form member were to be made hollow, it could be made out of a material which, like its wood predecessor, could be cut, sawed or otherwise mitered to fit corners and joints, while still maintaining the continuity of the drainage system. With the general idea having taken shape, I began a search of the trade literature and the teachings in other construction publications.

After an exhaustive search of building trade literature and in the United States Patent and Trademark Office patent files, I determined that teachings of a compound footing form-drainage device seem either vague or lacking in the attributes of my invention. I first sought footing/ foundation forms that carried with them (integrally) some form of venting or drainage; and alternately, I sought a drainage system that could somehow act as a concrete form. In all of the teachings or advertisements that I encountered, only a few appeared to even remotely approximate my concept. One of these is a patent issued to Frati in July 1972, U.S. Pat. No. 3,676,967, which is entitled "Forms For Concrete Wall Construction". Frati teaches a system of rectangular sheets, made of galvanized metal pans, that are assembled to construct wall forms at the construction site. Notwithstanding the teaching of a wall form, the Frati sheets are permanent, that is not degradable, and after use in-situ for construction of the wall, they are allowed to remain permanently affixed to the sides of the concrete core. Furthermore, Frati teaches a plurality of spaced vertical ribs projecting outwardly (as a series of partitions) from the inward-facing surfaces of each of the rectangular sheets, or pans. Finally, he teaches a passage of an air vent or a cableway through the core. Although certainly not a drainage feature, it may nevertheless be characterized as a conduit means passing through the wall itself, but it is not integral with the rectangular sheet, or pan structure; it must be emplaced after the form is set up. A second patent, most notable for the currency of its issue Oct. 1987, was that issued to Millman, U.S. Pat. No. 4,702,048, entitled "Bubble Relief Form For Concrete". Although not a form in the sense which I have now described generally, Millman teaches a light-weight, thermal plastic bubble insulation form for cast in-situ concrete slabs. He distinctly avoids calling the drainage feature, i.e., the bubble network, a concrete form because he specifically denotes another element, distinct from the bubble form, as the concrete "side forms". Millman is mentioned here because, although he does not contemplate or even intimate my invention, his teaching describes a drainage system which maintains permanent and intimate contact with the poured concrete. Another group of patents, those issued to Waller, U.S. Pat. No. 4,773,195, Crites, U.S. Pat. No. 4,757,651 and Freese, U.S. Pat. No. 4,840,515 are interesting teachings but, like the Frati and Millman disclosures, fall significantly short of my invention. Waller, for a "Method and Apparatus for Forming a Sluiceway Adjacent a Wall and Cement Floor", nevertheless teaches a drainage system which is, by the patentee's teaching, either degradable or removable. It is a conduit system which is basically applied to the inner wall of a concrete structure, not the footing, and allowed to serve as a temporary form for the base floor. Then, once the floor is set, the Waller form is removed or allowed to disintegrate, leaving a sluiceway adjacent the floor and wall juncture. It appears from a thorough reading of this patent that, in the situations I have contemplated for using my invention, the Waller device would still require a footing and external foundation drainage. Further, my experience warns me that the material chosen by Waller, although not conclusively defined, would nontheless be a detriment if allowed to remain in place. Most biodegradable or otherwise decomposable materials generally serve as attractions to insects, bugs or other vermin. Thus, in the final analysis, Waller's teachings would serve me no better than Milliman's; although admittedly, the cross section of his "L" shaped device appears to take on the general morphology of one of my alternate embodiments. Crites, is his "Wall System" teaches a baseboard type or device which is generally "C" shaped and is positioned adjacent the wall bas, just above a footing. The general "C" shape allows it to be fixed to the wall and the poured concrete floor to abut it. Crites further places a series of apertures aligned near the footing of the wall so as to drain fluid that might pass through the wall and accumulate in the hollow of the "C" chamber of his device. Thereafter, the water is allowed to collect and be conveyed via auxiliary tubing to a conventional tile drain located at the base of the footing. Crites, it appears, has taken the Waller idea and moved a step further by joining his permanent "sliceway" directly to an in-situ permanent footing drain system.

Final to my search for relevant disclosures are the patents issued to Harriett, U.S. Pat. No. 4,733,989 for "Self-healing Bentonite Sheet Material Composite Drainage Structure" and Freese, U.S. Pat. No. 4,840,515 for "Subterranean Drain". Harriett, the first to issue in Mar. 1988, relates to a layered water sealing article that includes a layer of flexible sheet material adhered to a layer of a composition comprising a nonhydrated, water-swellable clay, intimately contacted with a polypropene, polybutene (or mixtures) which is used as a water barrier. The clay layer is used to adhere to a wall, conduit, floor, etc. or other structure to be protected from water contact. In essence, Harriett provides a flexible, essentially hollow strip of material which, when adhered to a wall, will absorb and conduct drainage water through its structure to a conventional perforated drain pipe. The Freese patent, insofar as it discloses apparatus bearing a relevance to mine, varies little from the Harriett teaching. Furthermore, Freese also terminates the base of his subterranean drain with what he terms "the drain pipe". Thus, neither Harriett nor Freese teach a footing/foundation form and drain which has the dual purpose of providing a permanent poured concrete retainment while simultaneoulsy affording permanent footing drainage means.

Thus, in all of the patents and literature searched and found, I located neither a discrete disclosure of my invention, nor was I able to determine how I could combine any of the features provided by the aforementioned patentees to acquire a "self-draining mold" to suit my immediate needs. Although I could contemplate various devides such as the rigidifying of Freese or Harriett, the thickening and choosing of alternative materials for Waller, or the integration and incorporation of a free standing feature in Crites or Millman, it became readialy apparent that, since none of these inventors conceived, suggested or even implied such modifications, my general concept and embodiment of the instant invention were novel and certainly not apparent to those in the industry or the building trades.

SUMMARY OF THE INVENTION

I have made a unique form for a concrete footing or foundation casting by selecting a rigid, free standing, permanent mold form and adapting it for the conduction of water away from the footing/foundation that the form is used to mold. Thus, a single element has a dual purpose; and, by incorporating this duality of purpose in a singular device, I have provided means for lessening the costs of construction, easing the labor burden attendant in this specific construction and have provided an environmental benefit in that the likelihood of insect-attracting building refuse remaining after withdrawal of construction workers is greatly lessened.

The invention casting form comprises a rigid, nondecompassable (hereinafter "nondegradable") material in the general shape of a conventional plank (as aformentioned), having adjunct drainage means. The drainage means comprises a chamber or conduit passing through the plank or, alternatively, a conduit affixed to one side of the plank. The conduit, is perforated (or the plank possesses foramens) on one side, while the other side remains essentially planar, smooth and nonforaminous. When setting the footing form, the form planks are arranged in opposed registry with the smooth, unrelieved and nonforaminous surfaces defining the concretereceiving faces. Generically, I term the form a "retainment"; that is, its purpose is to retain the concrete. Thus, the form on the inside of the structure would provide, on its non-smooth, foraminous side, an interior drain conduit and, on the outside structure periphery the form would provide an external drain conduit. The conduits may be joined by under-the-footing conduit means which would run thence to the interior sump, or they may be joined to the sump individually or to an off-the-property sewer or drainage system, such as a drywell or open system. The forms, although free standing, must be constrained by the use of stakes. (For the remainder of this disclosure, I will use the term "constrainment" to mean a device or devices which prevent flexing of the forms planks). In some embodiments I have suggested the use of recesses in the forms so as to readily accept stakes which are used for constrainment. However, the only criterion of stake usage is that the stakes be made of a permanent, non-degradable material. By "nondegradable", I mean a non-decomposable, inedible and nondestroyable item that is generally impervious to the elements. The necessity of a non-degradable stake cannot be overemphasized. In areas of termite infestation, a single wood stake, for example, could have serious consequences. It is for such a reason that I have developed my invention with the view of using non-degradable materials throughout.

Two embodiments will be most useful: The first in which I use a rather unremarkable plank (elongate, rectangular strip) which has on one side thereof an attached conduit of triangular, rectangular or semi-circular morphology; and alternatively, a plank which is hollow, planar and unrelieved on one side and foraminous on the other. The first, in which the drainage conduit appears to be but an adjunct, has the advantage of economical fabrication. However, connection means must be provided at corners and joints of the form so that there will be a continuum formed in the drainage system. True, flexible ducting or tubing/tiling may be used or any form of around-the-corner conduit means; but, the alternative embodiment entertains a certain feature, compositional cutability, which allows avoidance of ducts. In choosing a nondegradable material, I also choose and recommend a material that will have not only the rigid characteristics required of the plank but also the cutable, sawable or weldable facets as well. High density thermo-plastic and thermosetting plastics are ideal; and, these provide the feature which overcomes the problem of joining the unique form drains of this invention. I purposely inculcate a mitering of all points of juncture when setting up the footing/foundation form. This may be accomplished with either the embodiments I have herein taught or, if the producer (manufacturer) of the invention wishes or for the sake of expediency, special corner couplings, such as I describe hereinafter may be used. Digression into the various forms of coupling, extensions, etc. for use with the basic elements of the invention, however, would unnecessarily stray from that teaching which is drawn to the nexus of the invention and the salient elements thereof. I see no reason to move or digress further into such mere mechanical adjuncts, the heart of the invention having heretofore been succinctly, but adequately, described. Those of ordinary skill will undoubtedly conceive of many useful connective and improvement devices, but shall be constrained by the claims which follow the detailed description of my invention.

BRIEF DESCRIPTION OF THE DRAWINGS

Of the Drawings:

FIG. 10 is a partial isometric illustration of the FIG. 1 embodiment permanently installed appurtenant a concrete footing and wall; and FIG. 11 is a partial illustration of the FIG. 1 embodiment depicting the FIG. 8 constrainment and exhibiting, with the use of phantom drawing, a strap/cord restrainment of the instant invention.

DETAILED DESCRIPTION OF THE PREFERRED EMBODIMENT

Before embarking on a detailed description of my invention, I will define a few terms, some of which I have previously mentioned. A "confinement" shall mean anything that confines or holds matter, of whatever kind. For example, I describe my form or mold, for the containment of concrete or any other plastic substance, as a confinement. Thus, I do not require that a confinement always be completely closed, but rather it may be adapted in any shape or form so long as it confines the particular matter it was designed to contain. In discussing and describing my invention, "constrainment" means, particularly, the holding and supporting of concrete forms by the use of stakes or similar apparatus. I use the nomer "retainment" when referring to the confinement of concrete by the forms of the invention, primarily the planks. A drainage ditch may also be described, using my definition, as a retainment for collecting/holding water. Finally, in order to clearly differentiate over the other terms, "restrainment" means a hobbling or securing (as against mobility) of articles by various devices such as straps or cords. Thus, I maintain a constant separation between the planks of my concrete footing/foundation forms by the use of restrainment devices, herein straplike, cordlike or hingelike elements. As mentioned earlier, "nondegradable" means non-decomposable, inedible and impervious (for all practical purposes) to the elements. I will use the terms "channel/conduit" to mean a feature for effecting fluid drainage, such as a tube or portion thereof, i.e., like a groove or channel. Finally, since a major feature of this invention is a preference for perforations in a salient element thereof, I shall use the term "foramen(s)-/foraminous" to mean hole(s)/the quality of being holed, slotted or perforated. Having defined the foregoing terminology, I now undertake a detailed description of the major elements of my invention.

Figure 1:
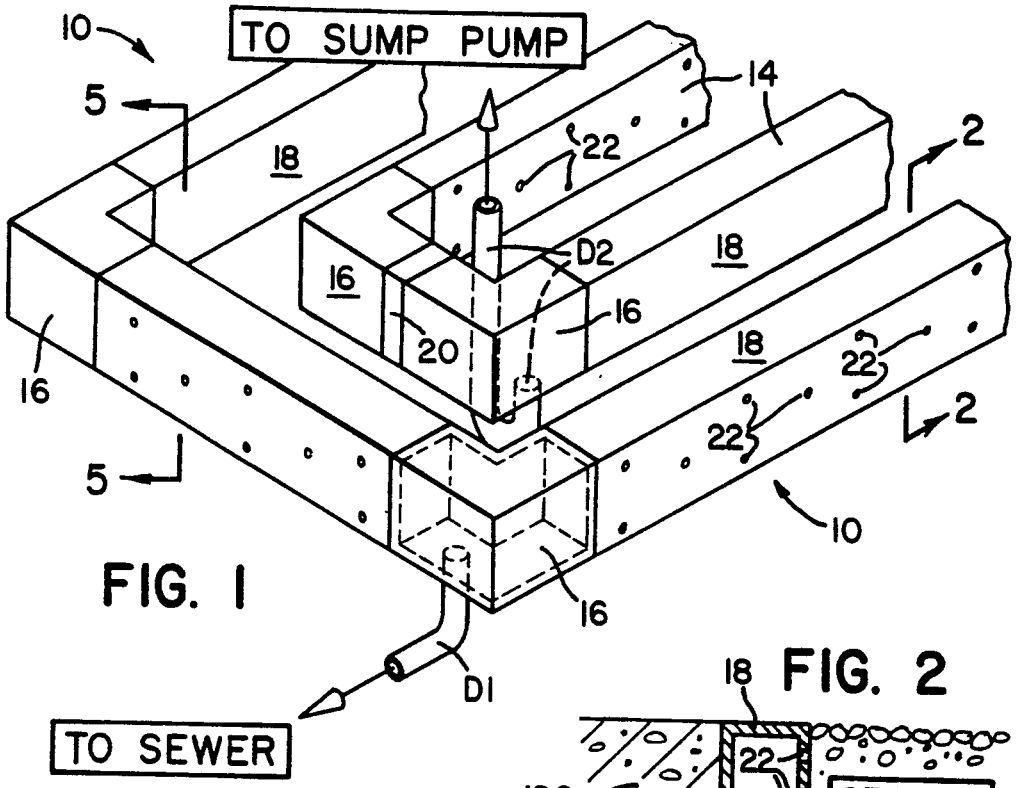
FIG. 1 is an isometric illustration of a partial footing form emplacement using the instant invention.

Referring more particularly to FIG. 1, a preferred embodiment 10 is shown in partial isometric illustration and properly disposed for the receipt of concrete, which would be poured between the two major elements for concrete confinement the external retainment form 12 and internal retainment form 14. Drain tubes D1 and D2 conduct liquid from the hollow interiors of internal and external forms 14 and 12 to sewer and inside-the-structure sump pumps, respectively. It is not the purpose of this disclosure to discuss matters pertaining to the plumbing of the footing/foundation but rather to show the ease with which such could be installed, as desired by those having ordinary skill. Suffice it to say that whenever the corner adapters 16 are employed, their hollow, rigid structure provides a base in which any similar tube or conduit may be installed. After this, the task of removing accumulated water is left to other tradesman who are better acquainted with it. Clearly seen in this figure are the major elements of the invention, namely planks 18, the corner adapters 16 and a short transition piece 20 which is placed between corner pieces, where required. I prefer to use the corner adapters 16 in pre-established form, allowing the tradesman who sets up the footing form 10 to adapt various sections of plank 18 by merely cutting them with a circular saw, hand saw or, when the fabrication material lends itself to it, a cutting torch. Most footing/foundation forms are of standard size. Thus, only three or four particular widths of corner adapter 16 may be required, one to form up sidewalks, another to form up heavier paved driveways and a third and, possibly a fourth for the various structural foundations. These specifications are better left to the producer or manufacturer of the invention. Final to FIG. 1, the reader should note the multiplicity of foramens 22 extant on the outward faces of external form planks 12 and the inward faces of internal form planks 14. The actual number of foramens 22 that are utilized in the individual planks 18 is another specification best left to the manufacture of the device. A suitable number of apertures must be provided so that drainage may be had effectively on the outside of the footing and on the inside, as well. So long as the apertures or foramens are small enough to preclude their filling with gravel or loose sand, and the bottom portion of the conduit forms an effective channel for the conduction of liquid therethrough, practically any arrangement may be entertained. Conversely, the faces of the individual planks opposedly forming the external form and the internal form must be non-foraminous in order to avoid filling of the plank conduit interiors with cement or concrete slurry. In an alternate embodiment, as will be seen hereinafter, great concern need not be payed since the drainage side (the foraminous or perforated side) of the forms unit planks are more readily distinguished.

Figure 2:
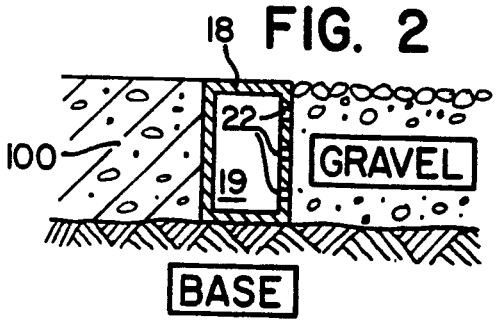
FIG. 2 is a cross-sectional illustration of the FIG. 1 article taken at 2—2.

FIG. 2 represents the cross-sectional elevation taken at 2—2 of FIG. 1. The depicted base is, of course, the footing/foundation base or trench bottom. Plank 18 is sectioned showing a hollow interior with foramens 22 facing towards the right side of the illustration. The cavity 19 of plank 18 clearly depicts the channel-like interior. In this placement, gravel is seen at the foramen side, while concrete 100 appears at the non-foraminous side. The thickness of the plank 18, in all the drawings, is somewhat exaggerated for the purposes of clarity and depiction herein; but, it may be seen that the lefthand side, particularly the side of plank 18 facing the concrete 100, is smooth, while the foraminous side faces the gravel through which (presumably) ground water travels to reach the periphery of the outside footing form. In a practical sense, the thickness dimension shown here may be diminished to as little as one-third the illustrated size. With foramens reduced to the number actually needed to provide effective drainage, the plank 18 would appear not much larger than an ordinary two by ten or two by 12 plank, say two and one-half to four by 12. The interior channel may be as narrow as one-half inch and still effectively provide the water accreation and conduction facility.

Figure 4:
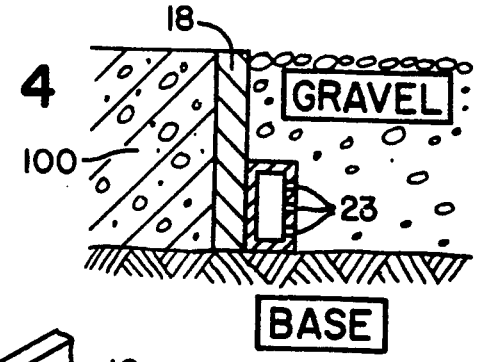
FIG. 4 is a cross-sectional illustration of the FIG. 3 article taken at 4—4.
Figure 3:
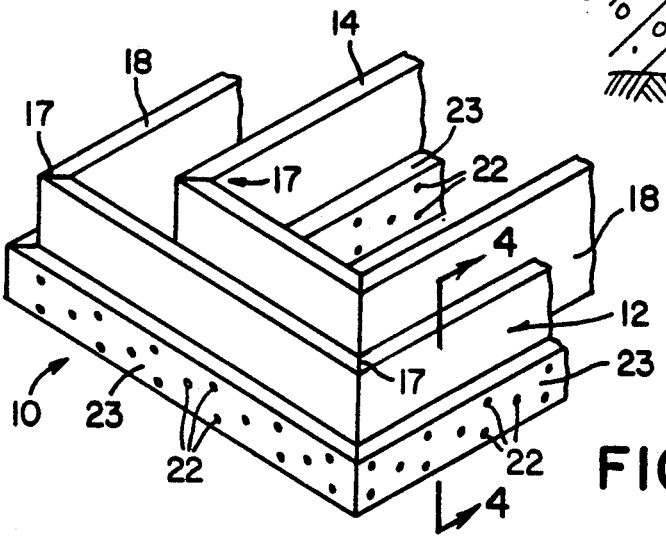
FIG. 3 is a partial isometric illustration of the FIG. 1 article in an alternate embodiment.

FIG. 3 represents an alternate preferred embodiment of the invention and bears two distinctive features that were not shown in FIG. 1. Firstly, the invention 10 is set up in the same fashion as that shown if FIG. 1 and external peripheral form 12 bears the same relationship to the internal peripheral form 14. In this case, however, planks 18 are nothing more than mere planks, albeit formed of the same non-degradable material as the drainage-conduit 23. A brief reference to FIG. 4, showing the 4—4 section of FIG. 3, reveals that plank 18 is indeed solid, while the foraminous conduit 23 appears fixed contiguously along the, bottom margin of the plank. As in FIG. 2, the inventions relationship vis-a-vis the concrete 100 and the gravel shown remains the same. Secondly, the feature that distinguishes this embodiment over the FIG. 1 embodiment is the lack of corner adapters 16; they are not required here in that, because of the cutability of the material used to make the invention, plank sections 18, as well as the rectangular shaped foraminous drain 23, may be mitered to fit as shown, thus eliminating the need for a corner adapter. Retrospectively, it is noted that the FIG. 1 embodiment shares this unique feature; and, in production, the miterability and perhaps inherent weldability of the material may allow the set-up of the footing/foundation form to be made with nothing more than a carpenter's circular saw and a three pound sledge, for driving stakes. If the family of high density plastic materials, both thermoplastic and thermoset, are used to manufacture the invention, it is likely that many of the joinings, whether using corner adapters 16 or mitered joints 17, may be greatly facilitated by the use of plastic cement such as presently used with many PBC or ABS plastics.

A disclosure of the salient elements of the invention having now been had, I would like to briefly present a few of the adjuncts which I provide with my invention in order to eliminate set-up problems and ease the workman's task in preparing a footing/foundation form.

Figure 5:
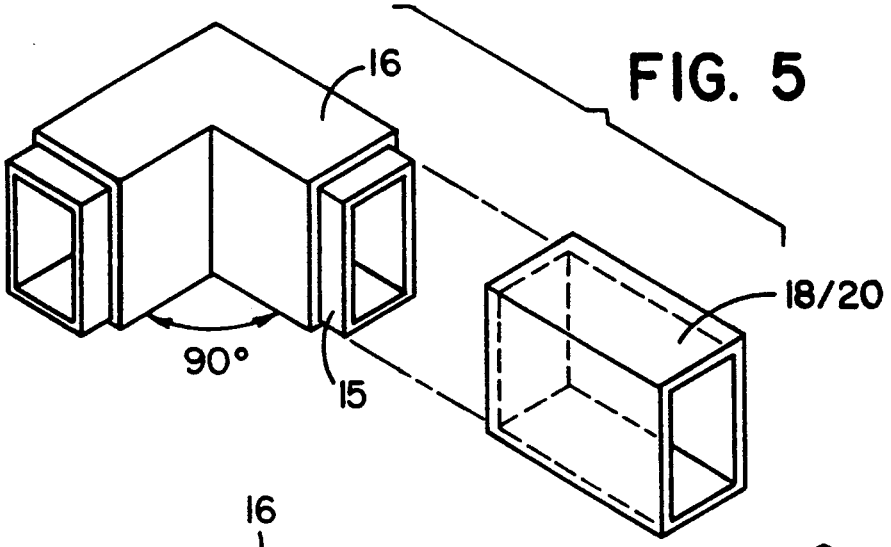
FIG. 5 is an isometric illustration of an optional corner connector for the FIG. 1 article with a short portion of the invention plank or transitional unit.
Figure 6:
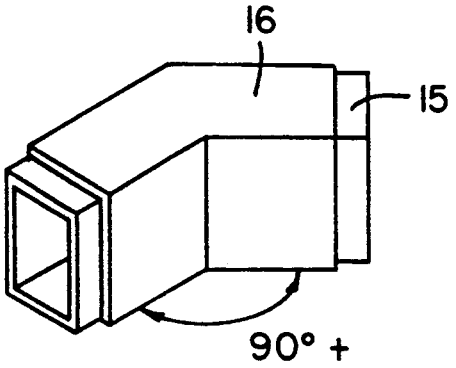
FIG. 6 is an alternate embodiment of the FIG. 5 device.
Figure 7:
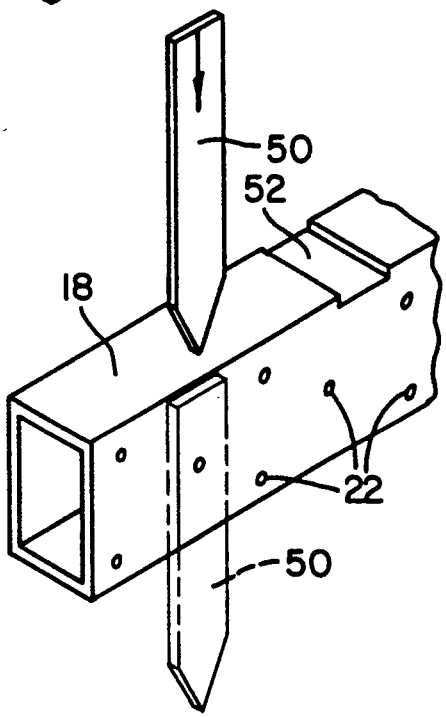
FIG. 7 is a partial isometric illustration of the plank of the invention as shown in FIG. 1, with a constrainment stake.
Figure 8:
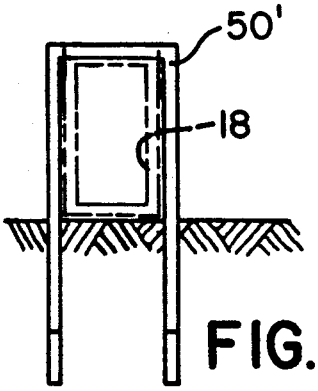
FIG. 8 is a cross-sectional illustration of an inverted "U" stake positioned over the plank of FIG. 7.
Figure 9:
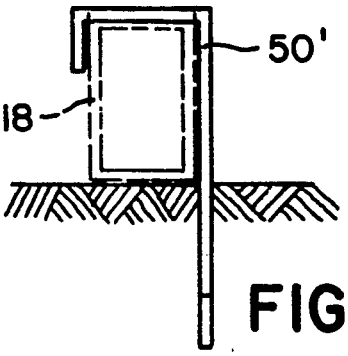
FIG. 9 is a cross-sectional illustration of an inverted "L" stake positioned over the plank of FIG. 7.

Reference being had particularly to FIGS. 5 and 6, corner or joint adapters 16 are shown in the orthogonal (or 90°) configuration and in the obtuse (or greater than 90°) configuration. A diminutive lip 15 is shown in these hollow adapters to facilitate connection with a plank 18 or transition piece 20. Those familiar plastic plumbing will readily recognize the rectangular analog of today's plastic piping. FIG. 7 relates still another adjunct, one which I term a constrainment. Although not part of the invention proper, stakes 50 are nonetheless needed to constrain movement and flexing of the planks 18, and are a relatively economical expedient for doing so. Also seen in this illustration is top notch 52, a transverse groove that may be set or molded into the top of the various planks 18 at predetermined distances. Such groovings 52 would greatly facilitate the use of inverted "U" or inverted "L" types of stakes as depicted in FIG. 8 and 9. The FIG. 8 and 9 stakes 50' may be of metal or other suitable composition that is nondegradable. They will have the advantage of later retaining the drainage portion of the invention (which is what the invention would be relegated to once the footing has set up and hardened) in position snugly against the footing/foundation edge. The reader should realize, however, that nothing more than the embodiment of stake 50, as shown in FIG. 7, is required.

FIGS. 10 and 11 show the final posturing of the invention in the hollow plank embodiment, and an additional set-up adjunct, respectively. FIG. 10, is an isometric drawing and, from the previous discussion is now self explanatory. FIG. 11, a partial isometric drawing, also has a phantom depiction of the invention. The set-up adjunct, which I referred to as a restrainment 60, is composed of a foldable, flexible or hingedly mounted foldable strap 60 attached periodically to margins of the planks and used mainly as a means for determining the spacing between planks 18 after one has already been set in place with stakes 50'. The restrainment is a very useful adjunct in that the oppositely positioned plank 18' may be readily set into the spaced-apart disposition and the concrete retainment (the full form) is acquired as soon as plank 18' is constrained by use of a similar stake 50'. Although many different forms of restrainment may be devised, I prefer a simple flexible plastic strap or cord made of a material similar to that used to fabricate the invention and the stakes. Many various sizes of foldable or flexible strap may be produced; and, the user has only to place the planks 18/18' in side by-side array and cement between them the requisite number of straps that will be needed to define the distance between the forms (and therefore the width) of the footing/foundation. I would also like to note that, in such an ensemble, the inverse "U" stakes 50' are especially useful in that they contain motion of the form's planks 18, in both lateral directions, and save labor by requiring the emplacement of a single unit, whereas the conventional staking method (also depicted in FIG. 7) requires always the driving of two stakes at periodic intervals along the length or longitudinal axis of the planks 18/18'. Practice using the invention will imbue the worker with a considerable amount of skill, allowing him to more expeditiously prepare footing/foundation forms while concomitantly and simultaneously allowing him to install the footing drain. The invention is elegant in its simplicity; and, many variations, as well as excursions, from the installation method taught herein may be readily had without departing from the intent or spirit of the hereinafter appended claims.

What is claimed is:

1. An installed-complete assembly comprising a free-standing concrete footing/foundation retainment of full footing/foundation height co-featuring an integral drainage means, the retainment comprising a rigid, free-standing plank for permanent, in-situ concrete retention, said plank possessing a first face, a nonforaminous second face and an integral drain means comprising channel/conduit means disposed therebetween, said drain means further comprising a plurality of foramens at one face of said plank, said plurality communicating with said channel/conduit means, said plank having a single nonforaminous continuous top surface and single nonforaminous continuous bottom surface and possessing top-bottom symmetry about the central horizontal plane therebetween, said plank having an end-fitting joint with a connector, which also possesses said top-bottom symmetry, by fitting engagement therewith and at least one non-biodegradable angular connector having a cross-section corresponding to a plank cross-section.

2. The invention of claim 1 further comprising retaining means of predetermined length attached periodically and removably proximate opposed margins of said first and second second planks, thereby constraining said first and second planks to said stand-apart registry of no more than a distance of the predetermined length of said restraining means.

3. The plank of claim 1 composed entirely of environmentally non-biodegradable material that is susceptible of cutting by suitable, mechanical or thermal means.

4. A permanently installed, in-situ, full height footing-/foundation form which requires no disassembly, for use in pouring concrete or similar plastic materials that subsequently rigidity to a shape dictated by said form, said form comprising in combination, a first plank and a second plank, both said first and second planks having a longitudinal conduit means passing therethrough, each said first and second planks having a planar, solid first face and a foraminous, reverse second face and nonformaminous top and bottom surfaces, the form further comprising non-biodegradable constraining means for posturing one of the planks on a lateral edge thereof with said first faces of each plank in opposing registry, and non-biodegradable flexible, spacing and restraining means of predetermined length attached periodically and proximate opposing edges of said top or bottom surfaces of said first and said second plank to restrain them from separating further than said predetermined length during set-up of said form.

5. The claim 4 invention wherein constraining means is at least one stake.

6. The claim 5 invention wherein restraining means comprises strap/cord means that connect at least edges of bottom surfaces and/or top surfaces of oppositely disposed first and second planks.

7. In a permanently installable and fully piecewise retainable full-height footing/foundation form which features therewith a drainage means, the improvement comprising a rigid, hollow, elongate plank having a nonforaminous top surface, a nonforaminous bottom surface, a first face and a nonforaminous second face, wherein the top and bottom surfaces are essentially of same breadth while first and second faces are of essentially same breadth and generally broader than said top and bottom surfaces, the plank further comprising a foraminous first face and a topbottom symmetry about the plane passing perpendicular to and through the first and second faces halfway between the top and bottom surfaces, said plank formed of a material that is impervious to water, is cuttable and is non-biodegradable, and further, the form comprises a plurality of hollow angular end-to-end coupling means of cross-section compactible with planks and connectable with more than one said plank to another and to form thereby continuous, enclosed concrete forms in various geometrical shapes.

8. The full footing-foundation form improvement of claim 7 further comprising at least one hollow joint adapter for connecting one said plank to another, said joint adapter comprising short, hollow conduit for effecting and maintaining form exterior and interior continuity from said first plank to the other, the adapter further characterized by said peripheral joining means comprising lip means suitable for engagement within a peripheral margin of an end of a plank.

9. The full footing/foundation form of claim 7 further comprising at least one rigid, environmentally non-biodegradable and non-removable stake means having in situ posture straddling the plank, the stake having the shape of an inverted "U".

10. A piecewise permanent full footing/foundation form co-featuring integral drainage means, comprising:

at least two rigid, hollow, elongate planks, a first plank and a second plank of heights sufficient to contain concrete placed therebetween to a depth defined by the heights of the planks and at least the height of a conventional foundation, each said plank having a top and bottom of essentially same breadth, a first face and a second face of essentially same breadth and generally broader than said top and bottom, each plank symmetrical about a central plane which is perpendicular to the first and second faces, the planks positioned on the top of one and the bottom of the other so that the first faces of each stand in opposed, and desired set-apart registry, said second faces of the first and second planks further comprising a series of holes which communicate with hollow interiors of the respective planks to permit water entry thereinto, each said plank having ends adapted for joinder to connector members of said form;

attachable, flexible strap means for periodically tethering said first and said second plank at top and bottom margins thereof in order to maintain said stand-apart registry, thereby expediting set-up of the form; and connector members for joining one plank to another, said connector members comprising hollow conduits of various angular or straight configuration and of cross-sections essentially the same as said planks.

11. The invention of claim 10 further comprising one or more "U" shaped, rigid, environmentally non-biodegradable stakes.

12. The invention of claim 10 further comprising one or more joint adapters to join one of said planks to a connectively placed other plank in order to provide continuity of flow for said water therethrough, said adapter comprising ends having protruding lip means for facilitating connection with any plank by fitting into an end margin thereof.

13. A method for installing a non-removable combination concrete foundation form with integral drain means and form connectors to insure a continuity of infused ground water flow about an inner and an outer periphery thereof comprising the steps:

predetermining a pattern for a concrete form comprising a plurality of non-biodegradable hollow planks, which said plurality contains the drain means;

selecting the necessary shaped non-biodegradable form connectors which when connected to said planks of said plurality will maintain said continuity about said inner and said outer peripheries; and setting out and connecting by suitable means the plank plurality with connectors necessary to effect desired footing shape and continuity in said pattern, wherein said setting out step further comprises gauging the distance between adjacent planks by utilizing a flexible, tethering means to effect rapid spacing between the inner and outer peripheries.

14. The method of claim 13 wherein said setting out includes constraining the form in place with suitable non-biodegradable stake means.

15. The method of claim 14 wherein setting out includes simultaneously placing a first plank in longitudinal set apart registry with a second plank and further drawing one plank away from the other in opposition to, and while each is tethered to, the other by a tethering means sufficient to maintain said set-apart registry during the constraining step of claim 14.

* * * * *